US007533609B2

(12) United States Patent
Harzbecker

(10) Patent No.: US 7,533,609 B2
(45) Date of Patent: May 19, 2009

(54) GUIDE ELEMENT FOR GUIDING A CLEANING APPARATUS OF A PRINTING PRESS

(75) Inventor: Thomas Harzbecker, Karlsruhe (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 13 days.

(21) Appl. No.: 11/784,731

(22) Filed: Apr. 9, 2007

(65) Prior Publication Data

US 2007/0234916 A1 Oct. 11, 2007

(30) Foreign Application Priority Data

Apr. 7, 2006 (DE) ..... 10 2006 016 863

(51) Int. Cl.
*B41F 35/00* (2006.01)

(52) U.S. Cl. ..... 101/425; 101/423

(58) Field of Classification Search ..... 101/425, 101/423

See application file for complete search history.

(56) References Cited

U.S. PATENT DOCUMENTS 3,581,658 A * 6/1971 Shepherd, Sr. ..... 101/132
4,387,647 A * 6/1983 Fischer ..... 101/350.2
6,640,712 B2 * 11/2003 Corti et al. ..... 101/425
2006/0191429 A1 8/2006 Jensen et al.

FOREIGN PATENT DOCUMENTS

| | | | |
|---|---|---|---|
| DE | 36 14 542 | A1 | 11/1987 |
| DE | 37 44 800 | A1 | 6/1989 |
| DE | 43 26 833 | A1 | 2/1995 |
| DE | 10000558 | A1 | 7/2001 |
| WO | WO 2004/087422 | A1 | 10/2004 |

OTHER PUBLICATIONS

European Search Report dated May 22, 2008.

* cited by examiner

*Primary Examiner*—Anthony H. Nguyen
(74) *Attorney, Agent, or Firm*—Laurence A. Greenberg; Werner H. Stemer; Ralph E. Locher

(57) ABSTRACT

A guide element for guiding a cleaning apparatus of a printing press contains a diverter which is configured such that it can be switched by the cleaning apparatus. The guide element can be operated manually and is therefore comparatively uncomplicated. An adjusting drive for the diverter is not present, as it is not required. The guide element is suitable for occasional maintenance work, in which the cleaning apparatus has to be removed from the printing press and introduced again.

7 Claims, 2 Drawing Sheets

GUIDE ELEMENT FOR GUIDING A CLEANING APPARATUS OF A PRINTING PRESS

CROSS-REFERENCE TO RELATED APPLICATION

This application claims the priority, under 35 U.S.C. §119, of German application DE 10 2006 016 863.1, filed Apr. 7, 2006; the prior application is herewith incorporated by reference in its entirety.

BACKGROUND OF THE INVENTION

Field of the Invention

The present invention relates to a guide element for guiding a cleaning apparatus of a printing press and the guide element contains a switchable diverter.

International patent disclosure WO 2004/087422 A1, corresponding to U.S. patent publication No. 2006/0191429 A1, describes a mounting system which contains a cleaning apparatus and a guide element having an adjustable closure plate. The guide element serves to guide the cleaning apparatus during its installation and dismantling in the printing presses.

Published, non-prosecuted German patent application DE 36 14 542 A1 describes a guide element which serves to guide a cleaning apparatus to various cylinders of a printing press. The guide element contains a diverter which is called a branching station and is switched by an actuating element. The actuating element is shown in the drawing in the form of an operating cylinder and is activated by program-controlled actuating commands. The guide element and the control device which is necessary for it are complicated and therefore suitable only for frequent displacements of the cleaning apparatus.

In many cases, however, only a rare displacement of the cleaning apparatus is required, in order, for example, to remove the latter for maintenance purposes from the printing press and to introduce it again after maintenance has been carried out.

German patent DE 43 26 833 B4 is also not really helpful for solving this problem. The publication describes a guide element having a diverter, by which the cleaning apparatus can be displaced optionally into various washing positions and into a parking position. In the parking position, the cleaning apparatus is readily accessible in order to exchange its washing element, for example a washing cloth, or for repair purposes.

SUMMARY OF THE INVENTION

It is accordingly an object of the invention to provide a guide element for guiding a cleaning apparatus of a printing press which overcomes the herein-mentioned disadvantages of the heretofore-known devices of this general type, which guide element is suitable for less frequent displacements of the cleaning apparatus and is uncomplicated.

The guide element according to the invention for guiding a cleaning apparatus of a printing press, contains a switchable diverter configured such that it can be switched by the cleaning apparatus.

The guide element according to the invention can be operated manually and is therefore comparatively uncomplicated. An adjusting drive for the diverter is not present, as it is not required. The guide element is very suitable for occasional maintenance work, in which the cleaning apparatus has to be removed from the printing press and introduced again.

In one development of the guide element according to the invention, the diverter can be configured such that it can be switched by a roller of the cleaning apparatus.

In a further development, the guide element can have a lower guide track for the roller and an upper guide track for a further roller of the cleaning apparatus.

In a further development, the diverter can have multiple arms.

In a further development, the diverter can have two arms which lie substantially on the same line.

Also part of the invention is a mounting system, containing a cleaning apparatus and a guide element having a diverter for guiding the cleaning apparatus during its installation and dismantling in a printing press, which mounting system is characterized in that the cleaning apparatus has an element which is guided by the guide element and is configured or disposed as a switching element for switching the diverter.

One constituent part of the mounting system is the guide element which is configured according to the invention or in accordance with one of the developments.

In one development of the mounting system, the guided element can be a roller.

Other features which are considered as characteristic for the invention are set forth in the appended claims.

Although the invention is illustrated and described herein as embodied in a guide element for guiding a cleaning apparatus of a printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
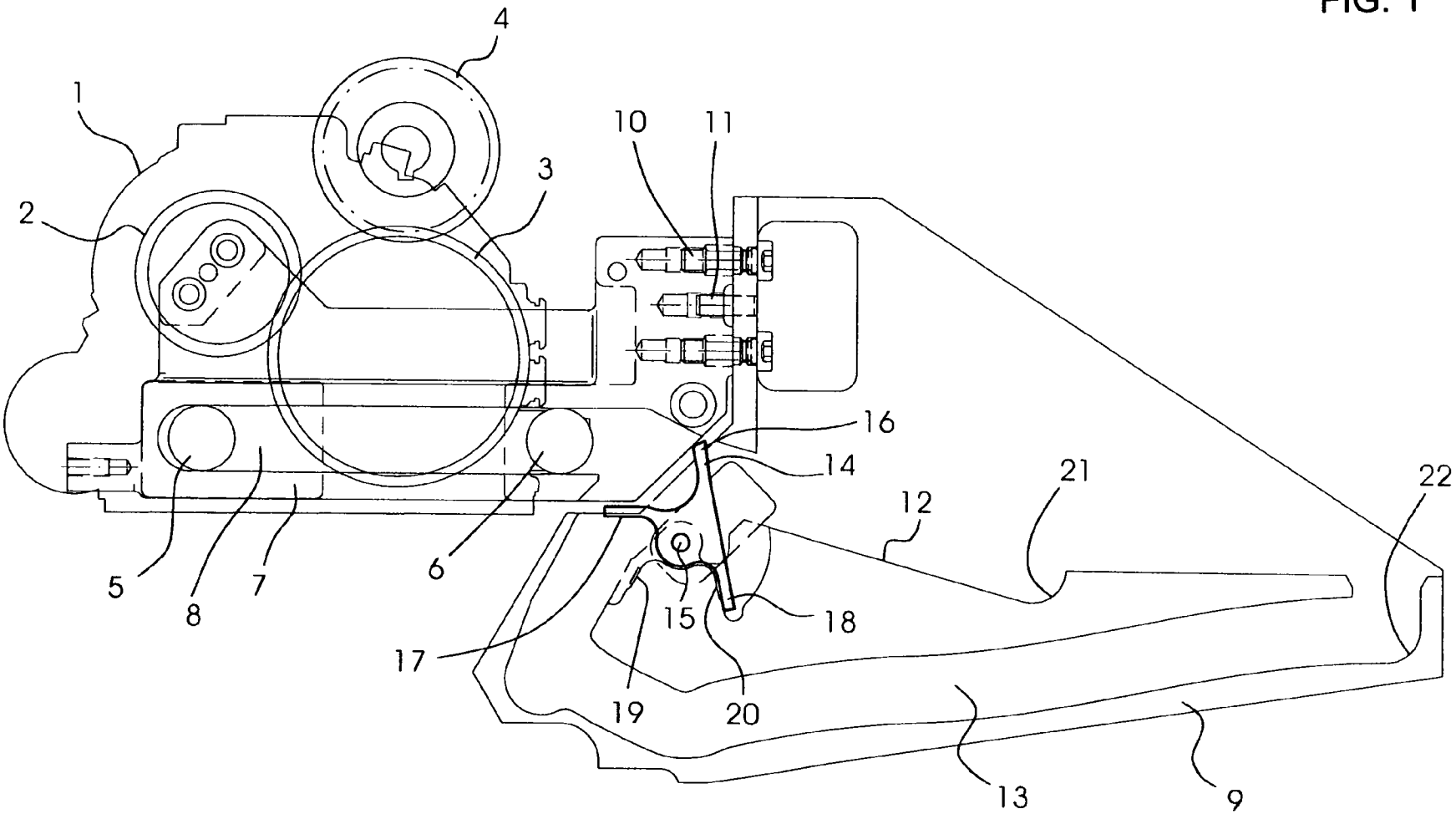
FIG. 1 is a diagrammatic illustration of a mounting system having a guide element and a cleaning apparatus which is situated in an operating position within a printing unit according to the invention.

Referring now to the figures of the drawing in detail and first, particularly, to FIG. 1 thereof, there is shown a mounting system for installing and dismantling a cleaning apparatus 1 in a printing press. The cleaning apparatus 1 is a rubber blanket washing device and contains a brush roller 2. Furthermore, the cleaning apparatus 1 contains a gear mechanism 3 for driving the brush roller 2. The gear mechanism 3 can be coupled to a gearwheel 4 which is mounted in a stationary manner on a machine frame. The gearwheel 4 drives the brush roller 2 via the gear mechanism 3.

The cleaning apparatus 1 is configured as what is known as a slide-in unit and has guided elements in the form of rollers 5, 6. One modification is conceivable, in which sliding blocks are present instead of the rollers 5, 6 as guided elements. Guide rails 7 having grooves 8 are attached permanently in the printing press. The rollers 5, 6 engage into the grooves 8 when the cleaning apparatus 1 is situated in its operating position which is shown in FIG. 1. It goes without saying that the cleaning apparatus 1 has a roller pair of this type both on the drive side and on the operating side, and a guide rail is disposed on each side.

Also part of the mounting system is a guide element 9 which is attached to the printing press by screws 10 and pins 11 when the cleaning apparatus 1 is to be installed or dismantled. The guide element 9 is therefore a mounting tool which is detached again from the printing press after installation of the cleaning apparatus 1 into the printing press has taken place. The guide element 9 has an upper guide track 12 for the front roller 5 with regard to the push-in direction and a lower guide track 13 for the rear roller 6. A switchable diverter 14 is disposed in a fork, in which the guide tracks 12, 13 branch off from one another. The upper guide track 12 falls away from the diverter 14.

Figure 2:
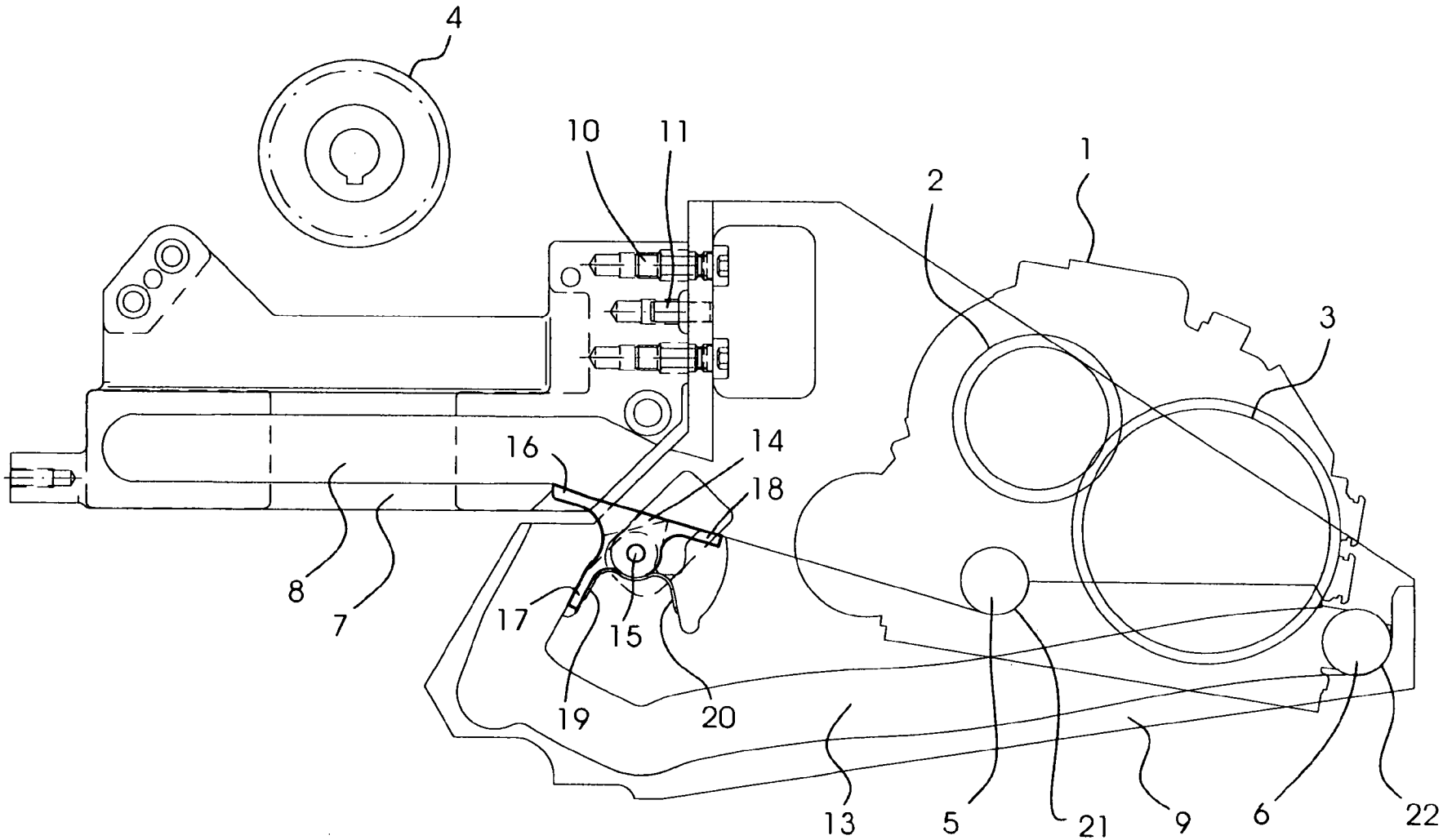
FIG. 2 is a diagrammatic illustration of the mounting system from FIG. 1, the cleaning apparatus being situated outside the printing unit and on the guide element.

The diverter 14 is mounted such that it can be rotated about a joint 15 optionally into two switching positions, of which one is shown in FIG. 1 and the other is shown in FIG. 2. The diverter 14 has a first arm 16, a second arm 17 and a third arm 18. The first arm 16 and the third arm 18 lie substantially on the same line and the second arm 17 is oriented at right angles or nearly at right angles with respect to the two other arms 16, 18. A fixing device in the form of magnets 19, 20 is disposed on the guide element 9, by which fixing device the diverter 14 is held fixedly optionally in its two switching positions. In the first switching position (see FIG. 1), the third arm 18 is held fixedly by the magnet 20 and, in the second switching position (see FIG. 2), the second arm 17 is held fixedly by the magnet 19.

It goes without saying that the guide tracks 12, 13 and the diverter 14 are also provided in a double arrangement, once on the drive side and once on the operating side.

The mounting system functions as follows: in order for it to be possible to remove the cleaning apparatus 1, for example for maintenance purposes, out of the printing press, first of all the guide element 9 is screwed on by the operating or maintenance personnel. The diverter 14 is then adjusted into its first switching position manually, if it is not already situated in the switching position. Subsequently, the cleaning apparatus 1 is pulled out of the printing press along the guide rail 7, the rear roller 6 coming into contact with the diverter 14. In the first switching position, the first arm 16 acts as a stop for the rear roller 6. Unintended rotation of the diverter 14 as a consequence of the rear roller 6 coming into contact with the first arm 16 is blocked by the third arm 18, by the latter bearing against the basic body of the guide element 9 or the magnet 20 which is let into the basic body and being held fixedly by the magnet 20.

If the rear roller 6 is situated on the second arm 17 which is aligned with the groove in the first switching position, the diverter 14 is switched via the rear roller 6 into the second switching position. Here, the rear end of the cleaning apparatus 1 together with the rear roller 6 is moved downward by the personnel or else under the action of the weight of the cleaning apparatus 1, with the result that the rear roller 6 presses onto the second arm 17 to such an extent that the third arm 18 is released from the magnet 20 and the diverter 14 is rotated in a counter-clockwise direction with regard to FIGS. 1 and 2. The guided element, that is to say the rear roller 6, is therefore arranged as a switching element for switching the diverter 14.

While the rear roller 6 presses the second arm 17 aside, it enters the lower guide track 13 which is groove-shaped. The rear roller 6 enters a substantially vertical section of the lower guide track 13, at the upper end of which the diverter 14 is situated and to the lower end of which a substantially horizontal section adjoins. As a consequence of the switching movement of the diverter 14 which is triggered by the rear roller 6, the second arm 17 comes into contact with the magnet 19 which then holds the second arm 17 fixedly.

After the diverter 14 has been displaced into the second switching position, the first arm 16, the third arm 18 and the upper guide track 12 form a common plane, as is shown in FIG. 2. When the cleaning apparatus 1 is pulled further out of the printing press, the front roller 5 is guided from the guide rail 7 onto the upper guide track 12 via the diverter 14, more accurately via the first arm 16 and the third arm 18. During this, the rear roller 6 moves along the horizontal section of the lower guide track 13. Finally, the front roller 5 reaches a trough-shaped stop 21 (see FIG. 1) at the end of the upper guide track 12 and the rear roller 6 reaches a trough-shaped stop 22 (see FIG. 2) at the end of the lower guide track 13, as is shown in FIG. 2. In this position, the cleaning apparatus 1 can be removed without problems from the printing press.

After maintenance has taken place, the cleaning apparatus 1 is moved into the position again, in which the front roller 5 is situated on the stop 21 and the rear roller 6 is situated on the stop 22. Proceeding from this position, the cleaning apparatus 1 is pushed back into the interior of the printing press along the guide element 9, the front roller 5 displacing the diverter 14 back into the second switching position (see FIG. 2), if the diverter 14 has accidentally been switched into the first switching position (see FIG. 1) after the removal of the cleaning apparatus 1. The front roller 5 comes into contact with the diverter 14, with the result that the first arm 16 folds downward and the third arm 18 folds upward, if the diverter 14 is not yet situated in the required second switching position.

If the diverter 14 bridges the gap between the upper guide track 12 and the guide rail 7, the front roller 5 can roll from the front guide track 12 via the diverter 14 onto the guide rail 7. During the further push-in movement, the rear roller 6 comes into contact from below with the first arm 16, as a result of which the diverter 14 is switched into the first switching position. During its movement upward, the rear roller 6 is situated between the second arm 17 and the first arm 16 which the roller 6 presses away, with the result that the path from the lower guide track 13 into the groove 8 becomes free for the rear roller 6.

After this, the cleaning apparatus 1 is pushed along the guide rail 7 into the operating position which is shown in FIG. 1, and the guide element 9 is removed from the printing press after reinstallation of the cleaning apparatus 1 has taken place.

The guide element 9 can be attached sequentially as a mounting aid to different printing units of the printing press and to different printing presses of the corresponding type, in order for it to be possible to remove the respective cleaning apparatus from said printing units and printing presses.

The guide element 9 ensures removal and introduction of the cleaning apparatus 1 which is free from collisions with adjacent machine parts. For example, collisions of the cleaning apparatus 1 with the gearwheel 4 are avoided, around which gearwheel 4 the cleaning apparatus 1 is guided reliably on account of the profile of the guide element 9.

I claim:

1. A guide element for guiding a cleaning apparatus of a printing press, the guide element comprising:

a switchable diverter being configured for being switched by an action of a switching element that is part of the cleaning apparatus.

2. The guide element according to claim 1, wherein said switchable diverter being configured for being switched by a roller of the cleaning apparatus.

3. The guide element according to claim 2, further comprising:

a lower guide track for the roller; and an upper guide track for a further roller of the cleaning apparatus.

4. The guide element according to claim 1, wherein said switchable diverter has multiple arms.

5. The guide element according to claim 4, wherein two of said arms of said switchable diverter lie substantially on a same line.

6. A mounting system, comprising:

a cleaning apparatus having a switching element; and a guide element having a switchable diverter for guiding said cleaning apparatus during installation and dismantling of said cleaning apparatus in a printing press, said switching element of said cleaning apparatus being guided by said guide element and being configured for switching said switchable diverter.

7. The mounting system according to claim 6, wherein said switching element is a roller.

* * * * *